United States Patent [19]

Alsup et al.

[11] 4,270,025

[45] May 26, 1981

[54] SAMPLED SPEECH COMPRESSION SYSTEM

[75] Inventors: James M. Alsup; Harper J. Whitehouse, both of San Diego, Calif.

[73] Assignee: The United States of America as represented by the Secretary of the Navy, Washington, D.C.

[21] Appl. No.: 28,406

[22] Filed: Apr. 9, 1979

[51] Int. Cl.[3] ..... G10L 1/00

[52] U.S. Cl. ..... 179/15.55 R; 358/135

[58] Field of Search ..... 179/1 SA, 1 SM, 15.55 R; 358/133, 135

[56] References Cited

U.S. PATENT DOCUMENTS

| | | | |
|---|---|---|---|
| 3,952,164 | 4/1976 | David et al. | 179/1 SA |
| 3,979,557 | 9/1976 | Schulman et al. | 179/1 SA |
| 4,045,616 | 8/1977 | Sloane | 179/1 SA |
| 4,076,960 | 2/1978 | Buss et al. | 179/1 SA |
| 4,142,066 | 2/1979 | Ahamed | 179/1 SA |

*Primary Examiner*—Charles E. Atkinson
*Assistant Examiner*—E. S. Kemeny
*Attorney, Agent, or Firm*—Richard S. Sciascia; Ervin F. Johnston; John Stan

[57] ABSTRACT

A sampled speech compression and expansion system, for two-dimensional processing of speech or other type of audio signal, comprises transmit/encode apparatus and receive/decode apparatus.

The transmit/encode apparatus comprises a low-pass filter, adapted to receive an input signal, for passing through low-frequency analog signals. A converter is connected to the low-pass filter for converting the analog signal into a digital signal. A buffer memory, whose input is connected to the converting means, stores the digitized signals.

A correlator, having inputs from the A/D converter and the buffer memory, correlates the digital signal received directly from the converter with a delayed signal from the buffer memory. An "interval-select" circuit, whose input is connected to the output of the correlator, uses the autocorrelation value as a basis for comparison with subsequent peaks in the correlation value which are greater than a specified fraction of the autocorrelation value. The interval-select circuit has an output which is connected to the buffer memory, the value of the fractional peaks and their timing being stored in the buffer memory.

A transform circuit, whose input is connected to the buffer memory, performs an even discrete cosine transform (EDCT) of the stored signal. A first modulator, whose input is connected to the output of the EDCT means, differentially pulse code modulates (DPCM) its input signal. A second modulator, whose input is connected to the output of the interval select circuit, differentially pulse code modulates its input signal. A multiplexer, having an input connected to the output of the first and second modulating means, combines the two differentially pulse code modulated signals. A receiver/decoder has circuits which perform an inverse function to those of the transmitter/coder and are arranged in inverse order, from input to output, to those of the transmitter/coder.

3 Claims, 3 Drawing Figures

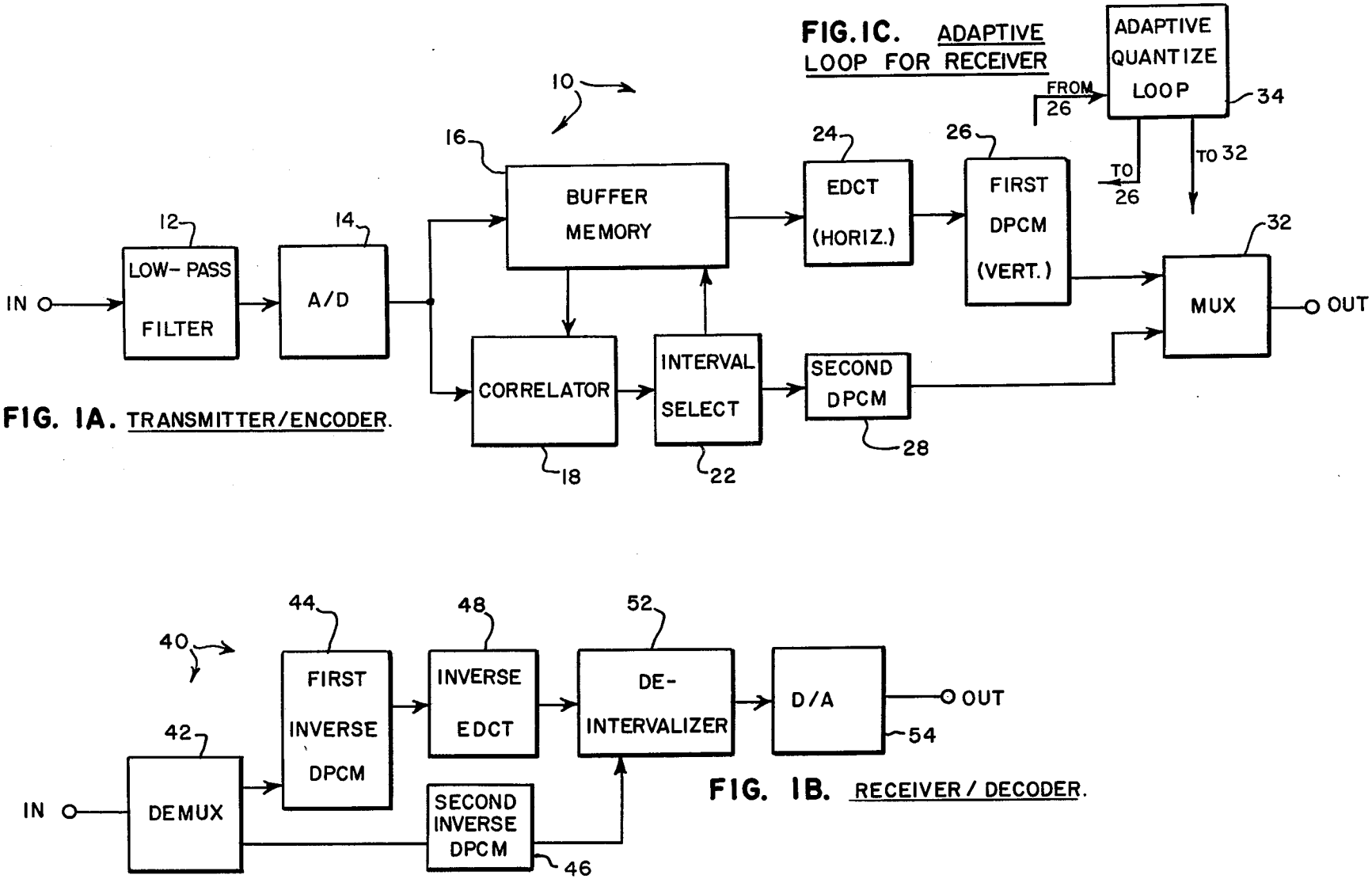
FIG. 1A. TRANSMITTER/ENCODER.
FIG. 1B. RECEIVER/DECODER.
FIG. 1C. ADAPTIVE LOOP FOR RECEIVER

SAMPLED SPEECH COMPRESSION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The speech-compression and expansion system involves the application of recent video data compression techniques to speech data. In order to effectively apply these techniques, the speech data should be segmented so as to achieve a high degree of correlation between corresponding samples and adjacent speech segments, allowing the formation of a two-dimensional speech "raster" with significant correlation in both dimensions. A method for generating such a two-dimensional format involves applying a hybrid cosine-transform/DPCM compression algorithm, as described by Habibi et al, "Real-Time Image Redundancy Reduction Using Transform Coding Techniques," IEEE 1974 International Conference on Communications, Record, Minneapolis, Minn., June 1974, pp. 18A1–18A8.

Traditionally, speech has been regarded as a one-dimensional time series, while television data has been regarded as a two-dimensional random process with correlation in both dimensions which can be exploited for data compression. In order to exploit well-developed two-dimensional compression algorithms and coding technology and also to visually study the structure of speech data, such data is presented herein as a series of television images with 256 levels of grey. The middle grey level, #128, is chosen to represent zero amplitude, while the white and black extreme levels are chosen to represent negative and positive maximum speech amplitudes, respectively.

Several types of transforms have been proposed and evaluated for use in video bandwidth reduction systems. These transforms have been described by Habibi et al, in the article described hereinabove. Among these are included the Karhunem-Loeve (K-L) transform, the Fourier transform, the cosine transform, the Hadamard, Walsh transform, and the slant transform.

Until recently, however, only one of these has been used with any success in the processing of speech data. This transform, the Fourier transform, along with its close logarithmic "cousins", has been used extensively in the implementation of Vocoder-type speech compression systems. These types of systems have been described by Rabiner, L. R. and B. Gold, "Theory and Applications of Digital Signal Processing," Prentice-Hall, N.J., 1975, pp. 687–691; Oppenheim, A. V. and R. W. Scheefer, "Digital Signal Processing," Prentice-Hall, N.J., 1975, pp. 518–520; and Bayless, J. W., S. J. Campanella, and A. J. Goldberg, "Voice Signals, Bit by Bit," IEEE Spectrum, October 1973, pp. 28–34.

As with video data, however, it is very likely that the redundant information in speech is more efficiently revealed via linear transforms more nearly like the K-L transform than the Fourier transform is, particularly when the length of the data block being transformed is small relative to a few hundred periods of the highest frequency component of interest.

The family of cosine transforms have this feature, in that they more nearly represent the optimum transform for revealing the redundancy of two-dimensional data than any of the other transforms listed (with the exception of the K-L transform, which is not amenable to as simple an implementation).

Cosine transforms for data compression can be implemented with discrete algorithms operating on sampled data. When sampling is assumed, then the resulting cosine transforms can be classified as "even" (EDCT), "odd" (ODCT), or "mixed" (MDCT).

These first two have been thoroughly discussed by Speiser, J. M., "High Speed Serial Access Implementation for Discrete Cosine Transforms," NUC TN 1265, Jan 8, 1974; and Whitehouse, H. J., R. W. Means and J. M. Speiser, "Signal Processing Architectures Using Transversal Filter Technology," 1975 *IEEE International Symposium on Circuits and Systems Proceedings,* Boston, April 1975. A brief general discussion of the discrete cosine transforms appears in the patent to Speiser, et al, entitled *APPARATUS FOR PERFORMING A DISCRETE COSINE TRANSFORM OF AN INPUT SIGNAL,* having the No. 4,152,772, dated May 1, 1979.

A paper, dealing with the general subject matter of this invention, has been presented by the co-inventors at the 1978 IEEE International Conference on Acoustics, Speech, and Signal Processing (ICASSP), (April 1978), under the title of "Two-Dimensional Speech Compression".

The application of the EDCT algorithm has only just recently been demonstrated by the inventors for speech data compression. The ODCT and MDCT algorithms have not yet been tried.

SUMMARY OF THE INVENTION

A system for two-dimensional speech, or other type of audio, processing has as its object signal bandwidth compression. It comprises transmit/encode apparatus and receive/decode apparatus.

At the input of the transmit/encode apparatus, a low-pass filter (at approximately 5kHz) receives audio signals, for example from a microphone or tape recorder, and transmits them to an analog-to-digital (A/D) converter. The digitized signal from the A/D converter goes, in two parallel paths, to a buffer memory and to a correlator. The correlator correlates a delayed version of the input signal from the buffer memory with a non-delayed version of the same signal.

From the correlator a signal goes to an "interval-select" circuit, which uses the autocorrelation value as a basis for comparison with subsequent peaks in the correlation function which are greater than a specified fraction of the autocorrelation value. The subsequent peaks results from the periodicity which comes about because of the periodic pulsing of the glottis in the throat. Effectively, the correlator measures the pitch period. If the chosen transform length is, say, 96 samples, then 96 samples are transformed via the even discrete cosine transform (EDCT). The interval-select circuit determines when the next 96 samples start, not necessarily where the last 96 samples stopped, because there will usually be an overlap. If the pitch period (as determined by the correlator) is 80 samples, then the overlap is 16 samples.

The balance of the circuit is similar to a TV bandwidth compression system. The outputs of both the EDCT circuit and the interval-select circuit go to two differential pulse-code modulation (DPCM) circuits. These circuits perform a vertical differencing operation on the successive transform coefficient outputs and the successive interval values of two adjacent horizontal lines, with quantization occurring in the process of taking the difference.

The vertical DPCM circuit may have an adaptive quantizer built into it. The quantizer determines, while signals are passing through it, at what level is should be set, depending upon the type of data passing through it, which depends upon the spectral characteristics of the speech.

The outputs of the two DPCM circuits go to a multiplexer, which combines the two DPCM signals, one of the signals serving to "frame" or time the pattern.

Receive/decode apparatus decodes the transmitted signal.

OBJECTS OF THE INVENTION

An object of the invention is to provide a speech compression system, using a TV-type raster in the process.

Another object of the invention is to provide a speech-compression system which utilizes small compact, LSI-type electronic apparatus optimally suited for the calculation of the discrete cosine transform family of transforms.

Yet another object of the invention is to provide a speech-compression system which may be used for the identification of speech patterns.

These and other objects of the invention will become more readily apparent from the ensuing specification when taken together with the drawings.

BRIEF DESCRIPTION OF THE DRAWING

The FIGURES, consisting of three parts, comprise block diagrams illustrating a two-dimensional speech processor for bandwidth compression, FIG. 1A showing a transmitter-encoder, for bandwidth compression; FIG. 1B showing a receiver/decoder for bandwidth expansion; and FIG. 1C showing an adaptive loop.

Description of the Preferred Embodiments

Referring now the FIGURES, therein is shown a sampled speech compression system for the two-dimensional processing of speech, or other type of audio signal. More specifically, FIG. 1A shows the transmitter-/encoder 10 of the speech-compression system, FIG. 1B illustrates the receiver/decoder 40 for the same system, while FIG. 1C shows an optional adaptive quantize loop.

Referring back to FIG. 1A, means, in the form of a low-pass filter 12, are adapted to receive an input analog signal, typically in the range of 5kHz. The analog signal may originate in a microphone or a tape-recorder.

Means 14, connected to the low-pass filter 12, convert the analog signal into a digital signal. Means 16, whose input is connected to the output of the converting means 14, store the digitized signals.

Means 18, having inputs from the converting means 14 and the storing means 16, correlate the digital signal received directly from the converting means with a delayed signal from the storing means. Typically, 96 samples would be stored per line of a rectangular speech pattern. If a correlation analysis were performed on all 96 samples, a maximum value would be obtained when there is no delay between the stored signal and the signal from the A/D converter 14. This is the autocorrelation value and is a positive number, since effectively a signal is being multiplied by itself.

Means 22, whose input is connected to the output of the means for correlating 18, uses the autocorrelation valve as a basis for comparison with subsequent peaks in the correlation function. Subsequent values which are greater than a specified fraction of the autocorrelation value are used to select the raster intervals. This means is labeled "interval select" 22, in FIG. 1A.

The output of the interval select 22 is connected to the means for storing, namely buffer memory 16, for the purpose of selecting which samples in that memory will be routed to the transform means 24. For instance, if the selected interval value is 50, then the next block of 96 samples allowed to progress to the transform block will begin at the 50th sample of the previous block.

The interval select circuit 22 uses the autocorrelation value of the current block (raster line) as a basis for comparison, and then looks for subsequent peaks in the correlation function which exceed some fraction of that value, for example 50 percent of that autocorrelation value. Generally, the secondary peaks would be located at sample delays corresponding to multiples of the pitch period.

The secondary peaks are a result of the periodicity of speech, due particularly to the periodic impulsing of the vocal, glottal, pulses. If the input signals are voiced speech signals, then the correlator 18 is actually measuring pitch period and its multiples. The interval select circuit 22 plays a key function in determining the pitch. Typically, pitch period ranges from about 2 ms to about 10 ms. For data sampled at 10 ks/s, the periods correspond to intervals ranging from 20 to 100 samples.

In more detail, the interval select circuit 22 would be used as follows. After the buffer memory 16 has stored the 96 samples, then the correlation analysis can begin. First, the auto-correlation value is calculated. Then, there is a wait for, say, two milliseconds during which time correlation values adjacent to the first one are ignored. Then, the interval selector 22 starts looking for a peak in the correlation function which indicates where the next pitch period arises. Assuming a 10 kHz sample rate, somewhere on the order of 50 or 60 samples later a peak may be obtained. This peak may be regarded as an "interval peak". The interval peak is used to decide which set of contiguous samples of the speech comes out of the buffer memory 16 on the next output phase. In the first output phase, a block of 96 samples is transferred from memory 16 to EDCT circuit 24. The interval select circuit 22 determines where the next block of 96 samples starts. The next block of 96 does not necessarily start right where the last block of 96 stopped. Rather, there will be some overlap in general, and so in fact the second block of 96 may start back where the 50th sample of the first block of 96 was stored, because it was at that value of delay the secondary peak was selected.

The second block of 96 samples will start at sample 50, and will extend for 96 samples from that point, and so will go from sample 50 to sample 146, for instance. Then, a new autocorrelation value will be calculated for the second block (raster) line, and the interval select circuit 22 will seek another secondary peak whose amplitude is 50 percent of the new peak autocorrelation amplitude.

The process of selecting intervals or pitch periods continues, with blocks of 96 samples continually being outputted and delayed by the number of samples, as determined by the interval select circuit 22, from the previous block of 96 samples. If the interval-select circuit 22 is unable to find any secondary peaks which exceed the threshold, then a default value of 96 is chosen for the next raster line. This occurs, for example, when either noise or silence are present in the signal buffer 16.

Each of the blocks of 96 samples goes from the buffer memory 16 into an even discrete cosine transformer 24. The size of the transform calculated by 24 is made equal to the raster width measured in number-of-samples, e.g., 96. This number is selected to be longer than some large fraction (say 95% to 99%) of the expected population of values of pitch period. From there, the transform signal goes into circuit 26, where it is differential pulse code modulated. The balance of the transmitter 10 is similar to what is done in a television bandwidth compression system. However, in the "ordinary" television bandwidth compression system, there is no requirement for an interval select circuit 22, which makes the speech-compressed raster a correlated raster. A conventional video bandwidth compression system is described by H. Whitehouse et al, in an article entitled "A Digital Real Time Intraframe Video Bandwidth Compression System", which appeared in the Proceedings of the International Optical Computing Conference, which took place in August 25–26, 1977.

In the conventional TV raster, successive blocks of 96 sample signals would be transformed by circuit 24, each group of 96 samples being aligned under each other.

The raster of this invention not only has correlation in a horizontal direction but also in the vertical direction. One can actually see stripes and other picture type detail extending vertically rather than just random samples scattered in a vertical direction. Normally in speech one would see structure only in the horizontal direction but with the samples aligned according to the pitch period there is also structure in the vertical direction.

Referring back to FIG. 1A, after the signal is transformed in an even discrete cosine manner in circuit 24, the signal enters first differential pulse code modulator 26, where the vertical processing is accomplished.

A DPCM operation is also used in television bandwidth compression. Essentially a differencing operation is performed on the successive transform coefficients, which results in taking a difference between one horizontal line and the next horizontal line. A vertical difference is taken in such a way that a quantization takes place in the middle of the differencing operation. (See the reference to Whitehouse et al., SPIE).

Means 34, having an input connected to, and an output connected back to, the first DPCM circuit 26, quantizes the input signal, thereby determining at what level the first DPCM circuit 26 should be set. The dotted lines between circuits 26 and 34 indicate that the adaptive quantize loop 34 is optional (i.e., fixed quantization rules can be used in first DPCM circuit 26 instead).

In video compression systems, a quantizer is used to give a very accurate representation of the brightness levels at low spatial frequencies, particularly the d-c frequency. As the spatial frequencies increase to higher ones, the accuracy with which those spatial frequencies were represented was reduced, and fewer and fewer bits were assigned to higher spatial frequencies, until finally at the very highest ones no bits were assigned. This is somewhat equivalent to a gradual low-pass spatial filtering operation.

The adaptive quantize loop 34 shown in FIG. 1C is used for a similar purpose in the invention. The quantize loop 34 decides how the loop should be set depending on the data stream. If the speech data coming in has certain spectral characteristics that could be averaged over a certain number, typically 16 or so successive transforms, then statistical means and variances can be determined. Then, bits can be assigned to the individual transform coefficients based on the standard deviations just calculated.

In the prior art these means and variances and standard deviations were calculated once and for all, and the adaptive quantize loop 34 was not required.

The input to the DPCM circuit 26 also provides an input to the adaptive quantize loop 34. The second DPCM circuit 28 also has the function of transmitting the value of the intervals of the chosen secondary peak. It is known that these intervals, which actually correspond to pitch periods, do not change very fast, which means that only a few bits would be required to encode successive outputs of the second DPCM circuit 28. Only one interval value per transform is required at the output of the multiplexer 32, so that it requires only about 1—96th of the hardware to implement the second DPCM 28 as compared to first DPCM to 26. In some way or other, the interval values must be transmitted, either the actual intervals themselves or the DPCM version of the intervals. If the former is chosen, then the second DPCM circuit 28 can be eliminated, and interval select values can be routed directly to the multiplexer 32.

Referring back to FIG. 1A, means 32, having inputs from the first and second DPCM circuits, 26 and 28, and the adaptive quantize loop 34, combine the two DPCM signals into a format for transmission which includes successive groups of one quantized-differential transform raster line and its associated interval value.

Referring now to FIG. 1B, therein is shown the receive/decode apparatus 40 of the speech compression system. The receive/decode apparatus 40 comprises a means 42, adapted to receive a multiplex signal, which demultiplexes or separates a differentially pulse code modulated signal into its two components.

A first and second means, 44 and 46, each having an input connected to the output of the demultiplexing means 42, perform an inverse differential pulse code modulation upon the first and second DPCM signals.

A means 48, whose input is connected to the output of the first inverse DPCM circuit 44, performs an inverse even discrete cosine transform on its input signal.

Means, having inputs from the inverse EDCT means 48 and the second inverse DPCM means 46, arranges the signals into a digital sequence, eliminating the redundant data present in adjacent inverse-transform 96-sample blocks.

A means 54, whose input is connected to the output of the de-intervalizer 52, converts the digital signal into an analog audio signal, which is similar to the analog audio signal which is the input to low-pass filter 12.

Discussing now in more detail the theory behind the sampled speech compression system, and beginning with the statistical techniques for reducing redundancy, the same statistical measures as described by Whitehouse, H. J., et al, "A Digital Real Time Intraframe Video Bandwidth Compression System," SPIE Proceedings Volume 119 (Applications of Digital Image Processing), August 1977, pp. 64—78, and used therein for video data reduction, are used here for speech data. This technique involves the selection of quantization rules used in the first DPCM 26, and the digital coding of the speech data transform coefficients according to a statistical measure of these coefficients. Namely, each frequency coefficient is averaged over some number of transforms larger than 1; the mean value and variance and standard deviation of each coefficient is calculated; and a number of quantization levels proportional to the standard deviation is assigned to each coefficient with that frequency over the range of transforms used in the average.

In the case of video data, a single bit-assignment rule is adequate for a large variety of pictures and for a variety of sub-block image portions within any given picture, so that an adaptive statistic may not be necessary. However, for speech data this situation does not prevail, and new bit-assignment rules for different portions of the speech data are, in general, required. These must be calculated "on the fly", and means for so doing are described herein below.

Typically, one can use the standard pulse code modulation (PCM) coding technique for encoding transform coefficients. Then to obtain bandwidth compression, one can use differential PCM in conjunction with quantization rules to reduce the number of bits/sec required to transmit the data. The rule of using a number of quantization levels proportional to the standard deviation of a coefficient reduces, for the case of uniform quantization, to the assignment of a number of binary digits (bits) equal to the base-2 logarithm of the standard deviation (plus a constant).

Finally, to achieve better bandwidth compression for speech, the statistics can be calculated in real time on the data being processed. When this technique is employed, some means must be provided for transmitting the quantization rule currently being used. This means is provided by the dotted line connecting adaptive quantize loop 34 to the output module 32.

The DCT is particularly well-suited for implementation either via a fast, pipelined FFT-like, digital structure as described by Whitehouse in his last referenced article, or via a CZT-like transversal filter structure. This latter structure, described by Whitehouse et al in the article entitled "Signal Processing Architectures Using Transversal Filter Technology, " has the virtue that additional size and power reduction can be realized through the use of charge transfer technology and its associated analog format. It is believed that this is the first time that the combination of sampled -analog CCD's with the DCT algorithm has been proposed for speech data processing and compression.

To calculate quantization rules "on the fly"; circuit 34 will need to be implemented as follows:

(1) To calculate variances, need buffer to hold m (e.g., m=8) transforms.

(2) Assume buffer is filled in rows, one row per transform.

(3) Then sum, non-destructively, in columns, creating a new row at the bottom, (row"a").

(4) Then scale sum (e.g., divide by factor of 8 by shifting magnitude bits 3 places to the right).

(5) Then, collect sum of squares of column elements in another row (row "b").

(6) Then, element-by-element, subtract square of values in row "a " from the values in row "b" and place the difference back into row "b".

(7) Sum non-destructively across this last row, add to a constant representing total number of bits available per sample and to a round-off quantity.

(8) Take this last sum and subtract from all elements in row "b", putting answers back in row "b" (or a neighbor row). This row now represents the quantizing "rule " to be used for the (e.g. 8) transform lines.

(9) This rule as contained in row "b" is fed back to the first DPCM circuit 26, and the 8 transforms are also routed to circuit 26 to be acted upon by it as delayed versions of what would normally be coming directly from the transform element 24.

(10) These DPCM/quantized rows can now be routed to the output multiplexer 32, along with a version or code representing the quantization rule which is transmitted as an overhead word for the group of 8 transforms (see dotted line from 34 to 32).

Some additional details regarding the operation of the correlator and the "interval select" circuit are now given:

(1) At some starting time, select (e.g., 96 contiguous speech samples to be the first (top) line of the raster.

(2) Next, take the next group of 48 samples, those immediately following the first, and form a new sequence which is the cascade of these (e.g., 144 samples long), and is 50% longer than the raster-width.

(3) Then take the first 48 samples of this 144-sample sequence and calculate the aperiodic cross-corelation function of this (48-point) sequence with the longer (144-point) sequence.

(4) Take note of the value of the "auto-correlation" position, where the first (48) points are aligned with themselves in both sequences.

(5) Beginning at a point (e.g. 48 samples) to the "right" of this point on the cross-correlation function (in the direction of full overlap of the (48-point) shorter sequence by the (144-point) longer sequence, look for a new maximum of comparable size to the "autocorrelation" value, using a peak-picker algorithm. This peak may be the first, second, third or perhaps even the fourth such peak as counted from the "autocorrelation" point, but will be the first one as counted from the 48th position of the cross-correlation function. Thus, this peak will lie somewhere in the range of 48-to-96 points away from the "autocorrelation" point. By "comparable size" it is meant that the value of th peak should exceed some threshold which may be 60%, or perhaps 40%, of the value of the "autocorrelation" point.

(6) Beginning at the location of this peak (e.g. 50th point), take the original speech data samples and construct the 2nd raster line of the same length (e.g. 96) as the first (e.g., samples 50 thru 135).

(7) Repeat steps (2) thru (6), beginning each time with 48-sample and 144-sample blocks whose initial sample is located one selected interval (e.g. 50 samples) later than the initial sample of the previous raster line. The resulting raster has constant width (e.g. 96 samples), and has a length which keeps going until the end of the speech data is reached. For excessively long data, or for indefinitely long real-time operation, some arbitrary number of raster lines (e.g., 250) can be grouped together, forming a sequence of "pictures" of the speech data.

(8) The raster just constructed has, or portions of it have, the property that successive lines are correlated with each other, although there is significant sample repetition to achieve this.

Summary of the output from the encoder/transmitter: What is transmitted, then, as the narrowband essence of speech, is the block-adaptive-differentially-quantized transform coefficients of the pitch-period-correlated-raster formed from phase-aligned segments (including some sample repetition) of the orginal sampled speech. An inverse procedure is used to reconstruct the facsimile of the original waveform.

It is anticipated that the techniques of this invention will be compatible with non-speech waveforms either superimposed upon the speech (with or without frequency separation), or by themselves. For example, music, noise, or low-frequency sonar signals might appear as "Background" to the speech, or as co-equal data occupying adjacent frequency bands.

Inasmuch as different individuals would generate different speech patterns, and therefore different two-dimensional rasters, the rasters of the system of this invention could be used for identification purposes.

Summarizing the invention, it contains three basically new features:

(a) The use of the family of transforms known as Discrete Cosine Transforms (DCT) to calculate a particular type of "spectral component set" which is significantly different from those related spectral components calculated via the Discrete Fourier Transform (DFT) and its logarithmic relatives (specifically, all transform coefficients are real, and the transform is invertible);

(b) The use of statistical techniques which can be straight forwardly implemented in an adaptive format to achieve favorable compression characteristics in the transform domain; and (c) The use of small, compact LSI-type electronic apparatus optimally suited for the calculation of the DCT-family of transforms.

Obviously, many modifications and variations of the present invention are possible in the light of the above teachings, and, it is therefore understood that within the scope of the disclosed inventive concept, the invention may be practiced otherwise than as specifically described.

What is claimed is:

1. A sampled speech compression and expansion system analogous to a two-dimensional processing of speech, or other type of audio signal, in that the processing is performed on sequences of sample data, each sequence comprising a line of data consisting of a plurality of samples, comprisng transmit/encode apparatus and receive/decode apparatus, wherein the transmit-/encode apparatus comprises:

means, adapted to receive an analog input signal, for filtering through low-frequency analog signals;

means, connected to the filtering means, for converting the analog signals into digital signals;

means, whose input is connected to the output of the converting means, for storing the digitized signals;

means, having inputs from the converting means and the storing means, for correlating the digital signal received directly from the converting means with a delayed signal from the storing means;

interval select means, whose input is connected to the output of the means for correlating, for comparing the autocorrelation value with subsequent peaks in the correlation function, identifying those peak values which are greater than a specified fraction of the autocorrelation value, and selecting one of them and the interval of time and the number of samples to the autocorrelation peak, the interval-select means having an output which is connected to the means for storing;

means, whose input is connected to the storing means so that specified blocks of stored signal are routed to it, with a starting point defined by the selected interval value, for performing an even discrete cosine transform (EDCT) of the stored signal;

a first means, whose input is connected to the output of the EDCT means, for differential pulse code modulation (DPCM) of its input signal;

a second means, whose input is connected to the output of the interval-select means, for differential pulse code modulation of its input signal;

each DPCM means determining a set of quantization coefficients according to a predetermined set of quantization rules; the speech compression system further comprising:

means, having an input connected to the output of the first and second modulating means, for multiplexing the two DPCM signals.

2. The speech compression system according to claim 1, further comprising:

means, connected to the first DPCM means, for calculating updated values of the quantization coefficients, thereby determining at what quantizing levels the first DPCM circuit should be set.

3. The speech-compression system according to claim 2, wherein the receive/decode apparatus for bandwidth expansion comprises:

a means adapted to receive a multipexed signal, which demultiplexes, or separated, the input signal into its two components;

first and second means, each having an input connected to the output of the demultiplexing means, for performing an inverse differential PCM operaton upon the first and second DPCM signal;

means, connected to the first inerse DPCM means, for performing an inverse even discrete cosine transform (EDCT) on its input signal;

means, connected to the inverse EDCT means and the second inverse DPCM means, which eliminates redundant samples, which comprise the difference in the number of samples in a line before a secondary peak was determined and the number of samples to the secondary peak, and arranges the EDCT output into digital sequence which corresponds to the digital sequence after A/D conversion in the transmit/encode apparatus; and means, whose input is connected to the output of the last-named means, for converting the digital signal into an analog audio signal.

* * * * *